United States Patent [19]

Blanchard et al.

[11] Patent Number: 4,722,739

[45] Date of Patent: Feb. 2, 1988

[54] DYEABLE SMOOTH-DRY CROSSLINKED CELLULOSIC MATERIAL

[75] Inventors: Eugene J. Blanchard, Metairie; Elwood J. Gonzales, Gretna, both of La.

[73] Assignee: The United States of America as represented by the Secretary of Agriculture, Washington, D.C.

[21] Appl. No.: 59,986

[22] Filed: Jun. 9, 1987

[51] Int. Cl.[4] ..... C09B 67/00

[52] U.S. Cl. ..... 8/597

[58] Field of Search ..... 8/181, 196, 597; 528/308.2, 272

[56] References Cited

U.S. PATENT DOCUMENTS 3,807,946 4/1974 Harper, Jr. ..... 8/181

*Primary Examiner*—Paul Lieberman
*Assistant Examiner*—John F. McNally
*Attorney, Agent, or Firm*—M. Howard Silverstein; David G. McConnell; Raymond C. Von Bodungen

[57] ABSTRACT

Dyeable smooth-dry crosslinked cellulose fabrics characterized by an amino acid derived of an N-methylol crosslinking agent on a cellulose substrate which can be dyed with basic or direct dyes are disclosed. Exemplary amino acids can be selected from the group such as glycine, alanine, serine, aspartic acid and glutamic acid.

16 Claims, No Drawings

DYEABLE SMOOTH-DRY CROSSLINKED CELLULOSIC MATERIAL

BACKGROUND OF THE INVENTION

1. Field of the Invention

This invention relates to dyeable cellulosic materials. More specifically, it relates to dyeing of cellulose which has been crosslinked with an N-methylol crosslinking agent in the presence of an amino acid.

2. Description of the Prior Art

Cellulosic material, such as cotton fabric, normally cannot be dyed after the material has been rendered smooth-dry. Fabric is usually dyed and then crosslinked with an N-methylol crosslinking agent to give fabric dimensional stability and durable press, smooth drying properties.

Nevertheless, under very limited conditions, some crosslinked cellulose containing basic grafts, such as grafts obtained through reaction of crosslinking agent with hydroxyalkylamines (ethanolamines), can be dyed with acid dyes (Harper et. al. U.S. Pat. No. 3,807,946). Also, crosslinked cotton containing acid grafts, such as grafts obtained through reaction of crosslinking agent with glycolic acid, can be dyed with basic dyes (Harper et. al. U.S. Pat. No. 3,788,804). There are other methods for dyeing crosslinked cellulosic containing fabrics, whereby cotton containing fabrics are treated with N-methylol crosslinking agent and polymeric materials, such as polyacrylates or polyurethanes, and then dyed with disperse dyestuffs (Blanchard et. al. U.S. Pat. No. 3,853,459).

SUMMARY OF THE INVENTION

This invention describes the production of a crosslinked cellulosic fabric, said fabric composed of a sufficient amount of N-methylol crosslinking agent and amino acid to give the fabric smooth drying properties and affinity for both cationic and anionic dyestuffs, especially basic and direct dye classes. The method involves treating cellulosic fabric with methylolated crosslinking agent and amino acid, followed by drying and curing for sufficient time at sufficient temperature to react the components with the fabric. The cured fabric is then dyed with either basic or direct dyestuffs to produce a colored, wrinkle-resistant fabric.

DESCRIPTION OF THE PREFERRED EMBODIMENTS

We have found that cotton fabric can be treated with N-methylol crosslinking agent and amino acid to produce a durable smooth drying cotton fabric with affinity for both cationic and anionic dyes. The significance of this is that the resulting fabric has affinity for at least two dye classes, which is an advantage over the use of hydroxy carboxylic acid with methylolated crosslinking agent in which case the fabric can be dyed only with basic dyes. In the preferred embodiments the carboxyl group of the amino acid allows the fabric to be dyed with basic dyes while the amino group gives the fabric affinity for direct dyes which have sulfonate groups in the form of the sodium salt.

Crosslinking of the fabric consists of treating the fabric with an aqueous solution of a methylolated crosslinking agent in concentrations of from about 3% to 10% and from about 2% to 8% of an amino acid for each 100 g of formulation. An acid catalyst, such as zinc nitrate hexahydrate, magnesium chloride hexahydrate or para-toluenesulfonic acid can also be used from about 0.15% to 4% based on the total solution weight of 100 g. The carboxyl group of the amino acid is sufficient to catalyze the reaction of the methylolated cross-linking agent with cellulose to produce smooth drying fabric but better smooth drying is obtained with external catalysts. The amino acids are selected from the group consisting of glycine, alanine, serine, aspartic acid and glutamic acid. Other amino acids in the series would be expected to be equally as useful. All of the above amino acids are readily water soluble except aspartic acid and glutamic acid, which have solubilities of less than 1 part in 100 parts of water. Solubility of these amino acids is achieved by converting the amino acid to the ammonium salt through addition of sufficient concentration of ammonium hydroxide to form an aqueous solution. Stable solutions of amino acid and N-methylol crosslinking agent, such as dimethylol dihydroxyethyleneurea (DMDHEU), or dimethylol propylcarbamate can be prepared over a wide pH range (pH 3–9) depending on the amino acid and the catalyst used.

After the fabric is treated with crosslinking agent and amino acid, it is dried from about 60° to 130° C. for about 3 to 7 minutes and then cured at from about 140° to 180° C. for from about 10 minutes to 2 minutes. The preferred curing conditions are 160° C. for 3–5 minutes. The fabric can be laundered to remove unreacted material prior to dyeing. Some fabric discoloration occurs upon curing and the degree of discoloration depends on the specific amino acid used. The fabric can be dyed immediately after curing and washing, but if lighter dye shades are desired the fabric can be bleached by treating with a bleaching agent, such as sodium borohydride or sodium perborate, before dyeing. Conditions for bleaching the fabric, if desired, are from about 0.25% to 2% of an aqueous solution of the bleaching agent at a temperature of 50°–80° C. for about 10–20 minutes. Fabric that is treated with 4% glutamic acid and 8% DMDHEU has a reflectance value of 70%, but after bleaching the reflectance value increases to 83% of the untreated cotton that is desized, scoured and bleached.

Crosslinked cotton fabric containing amino acid can be dyed with basic dyes. Basic dyes normally are used to dye acrylic and modified nylon fiber types, but the carobxyl groups of the modified cellulose containing amino acid have good affinity for the positively charged basic dye molecules. Direct dyes are used for dyeing cellulosic materials, but crosslinked cotton is not substantive to direct dyes because the crosslinking treatment prevents necessary fiber swelling, thus allowing dyestuff to diffuse into the fiber. However, crosslinked cotton fabric containing amino acid also has affinity for direct dyes because of the interaction of the amino group of the amino acid additive with the sulfonate anion of the dye molecule. The amino group must be protonized to positively charge the nitrogen atom to allow interaction with the negatively charged dye molecule. This is accomplished by adjusting the pH with suitable acid, such as acetic acid, of from about 2.5 to 4.0. The preferred pH range for dyeing with direct dyes is 3.0 to 3.5. Dyeing of crosslinked cellulose at this pH range is significant because unmodified cotton is usually dyed at slightly alkaline pH with direct dyes. Under such conditions, the amino acid crosslinked cotton has little or no affinity for direct dyes indicating that the pH of the dye bath is a critical factor for effective dyeing of the modified cellulosic material.

Fabric samples are dyed according to Procedure I for basic dyes and Procedure II for direct dyes. Procedure I consists of preparation of an aqueous dye solution containing of from about 0.25 to 10% basic dye, and 0–30% sodium sulfate based on the weight of the fabric. Acetic acid is used to adjust the pH from about 4.0 to 6.0 and the fabric samples are dyed at 80°–100° C. for 20–60 minutes. Samples are washed in water after dyeing to remove excess dye and then dried.

Procedure II consists of preparation of an aqueous solution containing of from about 0.25–10% direct dye and 10–30% sodium chloride based on the weight of the fabric. The pH is adjusted to from about 2.5 to 3.5 with acetic acid and the samples are dyed at 80°–100° C. for 20–60 minutes. Samples are washed in water after dyeing to remove excess dye.

The K/S values are determined on a spectrophometer according to the equation $K/S=(1-R)^2/2R$ where R is equal to the reflectance of the dyed sample at the wavelength of mzximum absorption.

EXAMPLE 1

Desized, scoured, and bleached cotton printcloth was treated with an aqueous solution containing 4% glutamic acid and 6% dimethyloldihydroxyethyleneurea. The pH of the solution was adjusted to 9 with ammonium hydroxide to promote solubility of the glutamic acid. The fabric was padded to 90% wet pickup and then dried and cured at 60° and 160° C. for 7 minutes and 3 minutes, respectively. The fabric was machine washed and then tumble dried. The treated fabric and an untreated cotton fabric were dyed with 5% Basic Red 29 and 20% sodium sulfate according to Procedure I at pH 4.4. After washing and drying, the treated fabric was dyed a deep red shade, whereas the untreated cotton was stained a light pink shade. This shows that cotton fabric containing an amino acid can be crosslinked and dyed effectively with basic dye which is not usually substantive to unmodified cellulose.

EXAMPLE 2

Cotton fabric was treated as in Example 1, except the solution contained 0.3% para-toluenesulfonic acid as the catalyst. A second sample of fabric was also treated, except the solution did not contain any amino acid and the pH of the solution was 3.2. After washing and drying both samples were dyed as in Example 1. After washing and drying again, the sample containing the amino acid had a deep red shade, whereas the crosslinked control sample was stained a very light shade of red. These results show that para-toluenesulfonic acid can be used in combination with an amino acid to catalyze crosslinking of cotton so as to obtain a dyeable, smooth drying fabric.

EXAMPLE 3

Cotton fabric was treated as in Example 1 except 6% glutamic acid, 6% dimethyloldihydroxyethyleneurea, and 1.6% para-tolunesulfonic acid was used in the aqueous solution. This fabric was dyed together with an untreated cotton fabric and another fabric treated as described above except no glutamic acid was used. The three fabrics were dyed according to Procedure II with 5% Direct Violet 104 and 20% sodium chloride followed by washing and drying. The sample containing glutamic acid had a K/S value of 10.16 at the wavelength of maximum absorption (530 nm). This fabric had very good dye sorption , but it was not quite as good as the untreated control which had a K/S value of 12.32. In contrast, the K/S value of crosslinked fabric without glutamic acid was only 7.12. This fabric had poor dye sorption. These results show that crosslinked fabric containing glutamic acid has improved affinity for direct dye.

EXAMPLE 4

A desized, scoured, and bleached cotton fabric was treated with an aqueous solution containing 4% aspartic acid and 8% dimethyloldihydroxyethyleneurea. The pH of the solution was adjusted to 8.5 with ammonium hydroxide to promote solubility of the aspartic acid. This fabric and an untreated cotton fabric was dried and cured as in Example 1 and then dyed with 5% Direct Red 81 according to Procedure II followed by washing and drying. The K/S value of the treated fabric was 11.5, and the K/S value of the untreated fabric was 11.2. This shows that a crosslinked cotton fabric containing aspartic acid can be dyed effectively with direct dye.

EXAMPLE 5

A cotton fabric was treated and dyed as in Example 4 except the treating solution also contained 2.4% magnesiumn chloride hexahydrate. After washing and drying the fabric was dyed red and had a K/S value of 8.5. This shows that a cotton fabric containing aspartic acid and crosslnked with N-methylol agent in the presence of metal salt catalyst can be dyed with direct dye.

EXAMPLE 6

A cotton fabric was treated and dyed as in Example 5 except the treating solution contained only 6% dimethyloldihydroxyethyleneurea and 2.4% magnesium chloride. The pH of the solution was about 4.0. The fabric had a K/S value of 1.7 after dyeing and it was only stained a very light red shade. This shows that crosslinked cotton has very little affinity for direct dye and cannot be dyed effectively without amino acid present.

EXAMPLE 7

Desized, scoured, and bleached cotton printcloth was treated with an aqueous solution containing 4% glycine and 8% dimethyloldihydroxyethyleneurea. The pH of the solution was 4.6. The fabric was padded to 90% wet pickup and then dried and cured at 60° and 160° C. for 7 minutes and 3 minutes, respectively. The fabric was machine washed and then tumble dried. A sample of this fabric, together with an untreated cotton sample was dyed with Basic Blue 78 according to Procedure I except 4% dye and 20% sodium sulfate based on the weight of the fabric was used and the liquor to fabric ratio was 20:1. The treated sample was dyed a deep blue color and had a K/S value of 18.02 at 610 nm. In contrast, the untreated sample was stained a light blue color and had a K/S value of 3.68. This shows that an amino acid increases the affinity of cotton for a basic, cationic dye on crosslinked cotton fabric.

EXAMPLE 8

A desized, scoured, and bleached cotton printcloth was treated and dyed as described in Example 7 except the treating solution also contained 0.5% para-toluenesulfonic acid. The fabric was dyed a deep blue color and had a K/S value of 16.0. This shows that an amino acid treated fabric crosslinked in the presence of an organic acid catalyst can be dyed with a basic dye.

EXAMPLE 9

A cotton fabric was treated and then dyed as in Example 7 except the treating solution also contained 2% magnesium chloride hexahydrate. The fabric was dyed a blue color and had a K/S value of 11.2. This shows that cotton fabric which is crosslinked with an N-methylol agent in the presence of an amino acid and a metal salt catalyst has affinity for basic, cationic dye.

EXAMPLE 10

A cotton fabric was treated and dyed as in Example 9 except the treating solution did not contain glycine. The dyed fabric had a K/S value of 2.0. This shows that crosslinked cotton without an amino acid additive has very little affinity for basic dye.

EXAMPLE 11

A cotton fabric was treated as in Example 7 except the treating solution contained 4% glycine, 6% dimethyloldihydroxyethyleneurea, and 0.65% zinc nitrate hexahydrate. The fabric was dyed according to Procedure I with 5% Basic Red 29 and 20% sodium sulfate. The fabric was dyed a deep red color (K/S=21.8 at 510 nm), whereas the untreated cotton was only slightly stained (K/S−3.22).

EXAMPLE 12

A cotton fabric was treated as in Example 7 except the treating solution contained 4% alanine instead of glycine. This fabric and an untreated cotton fabric were dyed with 5% Direct Red 81 and 20% sodium chloride according to Procedure II. The treated fabric was dyed a deep red color and had a K/S value of 12.2. The depth of shade was about the same as the untreated fabric which had a K/S value of 11.2.

EXAMPLE 13

A cotton fabric was treated and dyed as in Example 12 except the treating solution also contained 2.4% magnesium chloride hexahydrate. The fabric was dyed a red color and had a K/S value of 10.3. This shows that crosslinked cotton containing alanine can be dyed with direct dye because a dyed crosslinked fabric that did not contain any amino acid had a K/S value of only 1.7.

EXAMPLE 14

A cotton fabric was treated as in Example 7 except the amino acid used was serine instead of glycine. A sample of the fabric was dyed with 5% Basic Red 29 and 20% sodium sulfate according to Procedure I. The sample showed good affinity for the dye and had a K/S value of 13.3. The untreated sample had a K/S value of only 1.7 and showed very little affinity for the dyestuff.

EXAMPLE 15

A cotton fabric was treated and dyed as in Example 12 except the treating solution contained 4% serine instead of alanine. The treated fabric was dyed a red color and had a K/S value of 13.1, but this sample did not have any wrinkle resistance whereas the treated crosslinked fabric had good wrinkle resistance as well as good dye affinity.

EXAMPLE 16

A cotton fabric was treated and dyed as in Example 1 except no sodium sulfate was added. After dyeing the samples exhibited a deep red dyed shade as did the samples of Example 1. This example shows that the fabric can be dyed effectively without using salt.

We claim:

1. A dyeable smooth-dry crosslinked cellulose characterized by a amino acid derivative of an N-methylol crosslinking agent on a cellulosic substrate.

2. The dyeable smooth-dry crosslinked cellulose of claim 1 wherein the amino acid derivative is an imidazolidinone.

3. The dyeable smooth-dry crosslinked cellulose of claim 1 wherein the amino acid derivative is a carbamate.

4. The dyeable smooth-dry crosslinked cellulose of claim 1 wherein the amino acid is crosslinked with dimethyloldihydroxyethyleneurea on said cellulose substrate.

5. The dyeable smooth dry crosslinked cellulose of claim 1 wherein the amino acid is selected from the group consisting of glycine, alanine, serine, aspartic acid and glutamic acid.

6. The composition of claim 1 wherein the cellulosic substrate is cotton fabric.

7. A dyed smooth dry crosslinked cellulose of claim 1.

8. A dyed smooth dry crosslinked cellulose of claim 6.

9. A process for producing a dyeable cellulose comprising affixing an amino acid derivative of an N-methylol crosslinking agent to cellulose for the purpose of imparting smooth dry and dyeability characteristics thereto.

10. The process of claim 1 wherein the product is dyed with a basic or a direct dye.

11. The process of claim 10 wherein the cellulose is cotton fabric.

12. The process of claim 10 wherein the amino acid derivative is an imidazolidinone.

13. The process of claim 10 wherein the amino acid derivative is a carbamate.

14. The process of claim 10 wherein the amino acid is crosslinked with dimethyloldihydroxyethyleneurea.

15. The process of claim 10 wherein the amino acid is crosslinked with dimethylolpropylcarbamate.

16. The process of claim 10 wherein the amino acid is selected from the group consisting of glycine, alanine, serine, aspartic acid and glutamic acid.

* * * * *